United States Patent [19]

Billingsley, Jr. et al.

[11] Patent Number: 4,696,238

[45] Date of Patent: Sep. 29, 1987

[54] END STRUCTURE FOR RAILWAY CAR

[75] Inventors: Robert H. Billingsley, Jr., Allegheny County, Pa.; Steven L. Jantzen, St. Charles County, Mo.; Walter E. O'Leary, St. Louis County; John A. Krug, St. Charles County, both of Mo.

[73] Assignee: ACF Industries, Incorporated, Earth City, Mo.

[21] Appl. No.: 792,215

[22] Filed: Oct. 28, 1985

[51] Int. Cl.[4] ..... B61D 7/00; B61D 17/00

[52] U.S. Cl. ..... 105/248; 105/411; 105/414; 105/420

[58] Field of Search ..... 105/238 R, 247, 248, 105/396, 404, 407, 411, 413, 414, 416, 418–420, 238.1

[56] References Cited

U.S. PATENT DOCUMENTS

| | | | |
|---|---|---|---|
| 891,297 | 6/1908 | Shallenberger | 105/420 X |
| 1,547,639 | 7/1925 | Campbell | 105/420 |
| 2,092,457 | 9/1937 | Kiesel, Jr. | 105/247 |
| 3,339,499 | 9/1967 | Charles et al. | 105/248 |
| 3,509,827 | 5/1970 | Sutter | 105/248 |
| 3,577,933 | 5/1971 | Ferris et al. | 105/416 X |
| 4,362,111 | 12/1982 | Stark et al. | 105/247 |
| 4,563,957 | 1/1986 | Billingsley et al. | 105/247 X |

FOREIGN PATENT DOCUMENTS

| | | | |
|---|---|---|---|
| 635018 | 9/1936 | Fed. Rep. of Germany . | |
| 2030278 | 12/1971 | Fed. Rep. of Germany | 105/413 |

OTHER PUBLICATIONS

WO83/01920, Filament Wound Railway Hopper Car, ACF Industries, Inc.

*Primary Examiner*—Randolph A. Reese

*Attorney, Agent, or Firm*—Polster, Polster and Lucchesi

[57] ABSTRACT

An end structure for a center stub sill railway car is disclosed in which diagonal side sill extensions incline inwardly from the side sills to the center stub sill side for transmitting the longitudinal train loads between the stub sill and the side sills with the side sill extensions constituting the only horizontal, longitudinal load path between the stub sill and the side sills. A truss is disposed in a vertical transverse plane for transmitting overturning moments between the end of the car and the center stub sill.

13 Claims, 12 Drawing Figures

END STRUCTURE FOR RAILWAY CAR

BACKGROUND OF THE INVENTION

The invention relates to a stub center sill-type of railway car, such as a covered hopper car or the like. Such stub sill cars have, in the past, utilized a center stub sill assembly so as to securely mount the coupler to the car. These cars had side sills which ran lengthwise of the car at the lower, outer sides of the car. These side sills carried tension and compression lengthwise of the car. A horizontal shear plate was secured to the center stub sill assembly above the level of the coupler, and this shear plate extended laterally of the car and was secured to the end portions of the side sills so as to transversely transmit loads from the center stub sill to the side sills. The shear plate was reinforced by an end sill extending vertically from the outer transverse edge of the shear plate and by an upper bolster web secured to the inner transverse edge of the shear plate such that the shear plate, the end sill, and the upper bolster web formed a generally channel-shaped weldment so as to transfer loads from the center stub sill to the side sills. Such a construction is shown in FIG. 12. Because the shear plate was located above the longitudinal axis of the coupler, and since the coupler was capable of transmitting very high forces from the coupler to the center sill and thence to the side sills, this construction induced considerable eccentric loading, which in turn applied considerable moments to the end structure of the car. To counteract these eccentric loads and moments, additional structure, such as diagonal stiffeners, and upper bolster web stiffeners were welded to the shear plate.

Reference may be made to the prior co-assigned U.S. Pat. Nos. 3,339,499 and 3,490,387 which disclose prior art covered hopper cars having end frame constructions generally as above-defined. In the railway car disclosed in the above-noted U.S. Pat. No. 3,339,499, the end structure employed diagonal end struts or gussets which were secured along their inner edges to the inclined end slope sheets of the car and to the upper bolster web so as to form a rigid structure for reacting moments. The moments generated from impact or squeeze forces and draft loads acting on the car were reacted by a statically indeterminate structure formed by the upper end bulk head, upper bolster web, end slope sheet, and diagonal struts or braces which formed the prior art end frame structures. In this statically indeterminate structure, it was difficult to ascertain load paths and it was suspected that extra material and excess weight was required to carry the loads.

In the prior co-assigned U.S. Pat. No. 3,490,387, an end structure for the car was provided in which the forces carried by each of the members could be more readily determined such that more efficient use of the materials utilized to construct the end structure of the car could be attained. However, the car end frame construction utilized in the prior U.S. Pat. No. 3,490,387 still utilized a transverse shear plate, diagonal braces, and other members to connect the center sill to the side stub sills and to react moments, as generally shown in FIG. 12 herein.

The co-assigned U.S. Pat. No. 4,168,665 also discloses a center stub sill covered hopper car construction in which a corrugated bolster web is provided such that the corrugations served to reinforce the bolster web.

SUMMARY OF THE INVENTION

Among the several objects and features of the present invention may be noted the provision of a center stub sill-type railway car which employs an end structure so as to eliminate the necessity of the shear plate so as to transfer longitudinal loads between the center stub sill and the side sills, which in turn results in substantial weight and cost savings;

- The provision of such a railway car end structure which is easier to fabricate than prior art cars utilizing a shear plate end structure in that considerable welding is eliminated;
- The provision of such an end structure which facilitates repair and lowers the cost of repair of the end structure (if such repair becomes necessary);
- The provision of such an end structure which eliminates the necessity of a separate body bolster upper cover plate and a separate horizontal web plate for the center stub sill assembly; and
- The provision of such an end structure which is efficient in transmitting loads between the center stub sill and the side sills, and which is of rugged and economical construction.

Other objects and features of this invention will be in part apparent and in part pointed out hereinafter.

Briefly stated, a center stub sill railway car is disclosed having a center stub sill at each of the car carrying a coupler and a pair of spaced side sills generally at the level of the center stub sills and extending longitudinally of the car. Means is provided at each end of the car, extending diagonally between the end portions of the side sills and a respective center stub sill for transmitting longitudinal loads between the center stub sill and the side sills.

In another embodiment, this invention relates to an end structure for a center stub sill railway car in which a tie plate is secured over the center stub sill. Each of the side sills has an angular end portion thereof extending generally inwardly from the ends of the side sills to the center stub sill at an angle with respect to the longitudinal axis of the car, ranging between about 20 degrees and 70 degrees. These angular end portions are secured to the tie plate for transferring loads to the center stub sill to the side sills.

In another embodiment of the present invention, a tie plate is secured over the center stub sill, and each of the side sills has an angular end portion extending generally from the end of the car inwardly toward an associated center stub sill at an angle with respect to the longitudinal axis of the car ranging between about 20 degrees and 70 degrees. This angular end portion extends over the tie plate, and is secured thereto for the transfer of loads from the center stub sill to the side sills.

BRIEF DESCRIPTION OF THE DRAWINGS

Corresponding reference characters indicate corresponding parts throughout the several view of the drawings.

DESCRIPTION OF THE PREFERRED EMBODIMENT

Figure 1:
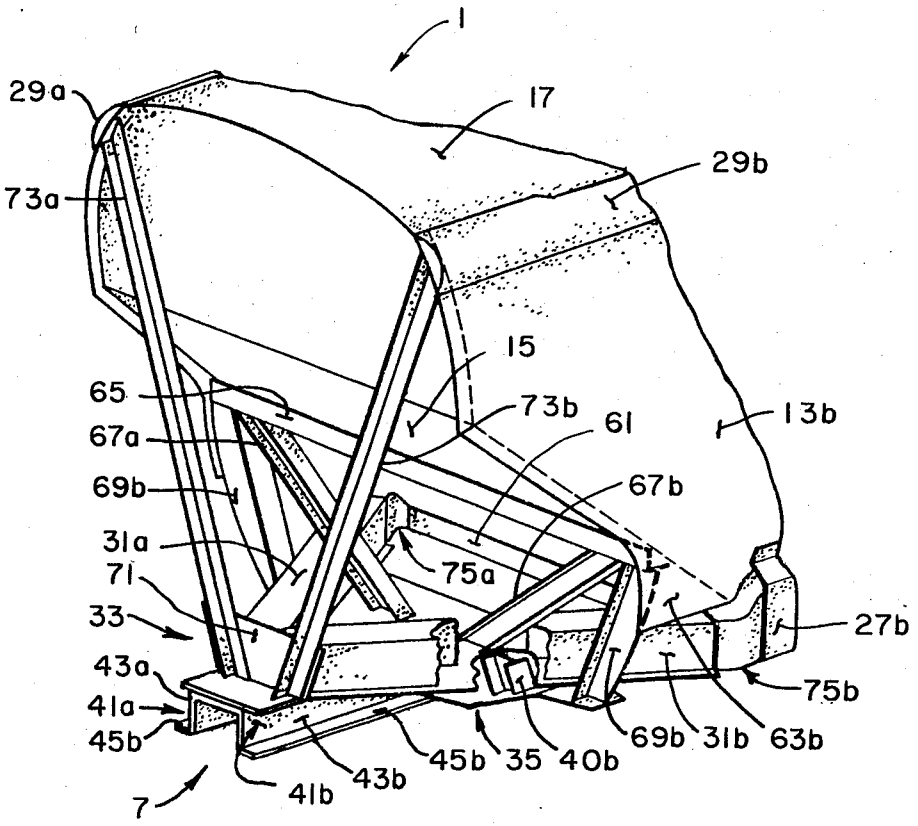
FIG. 1 is a three-fourths perspective of one end of a railway covered hopper car of the present invention, having a center stub sill and an end structure in accordance with the present invention.

Referring now to the drawings, a railroad car, and more particularly, a center stub sill covered hopper car, is shown in its entirely by reference character 1. The railroad car includes a car body 3 having an end structure 5 of the present invention at either end of the car body. Only one such end structure 5 is shown since the end structure is identical at each end of the car.

Figures 2, 12:
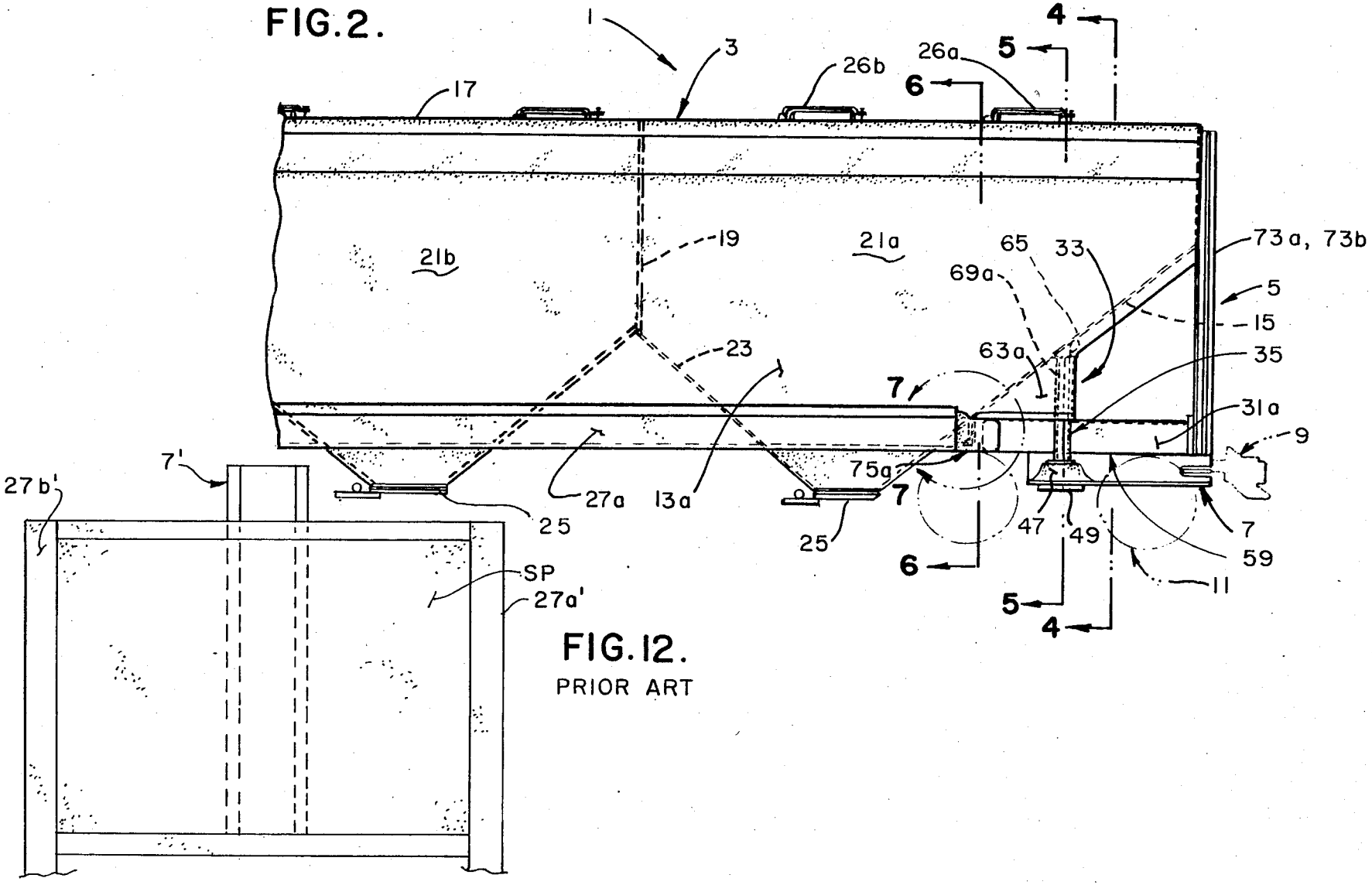
FIG. 12. PRIOR ART
FIG. 2 is a side elevational view of a railroad car of the present invention, with the truck assembly shown in phantom.
FIG. 12 (sheet 2) is a view similar to FIG. 11 of a conventional shear plate center stub sill railway car.
Figure 5:
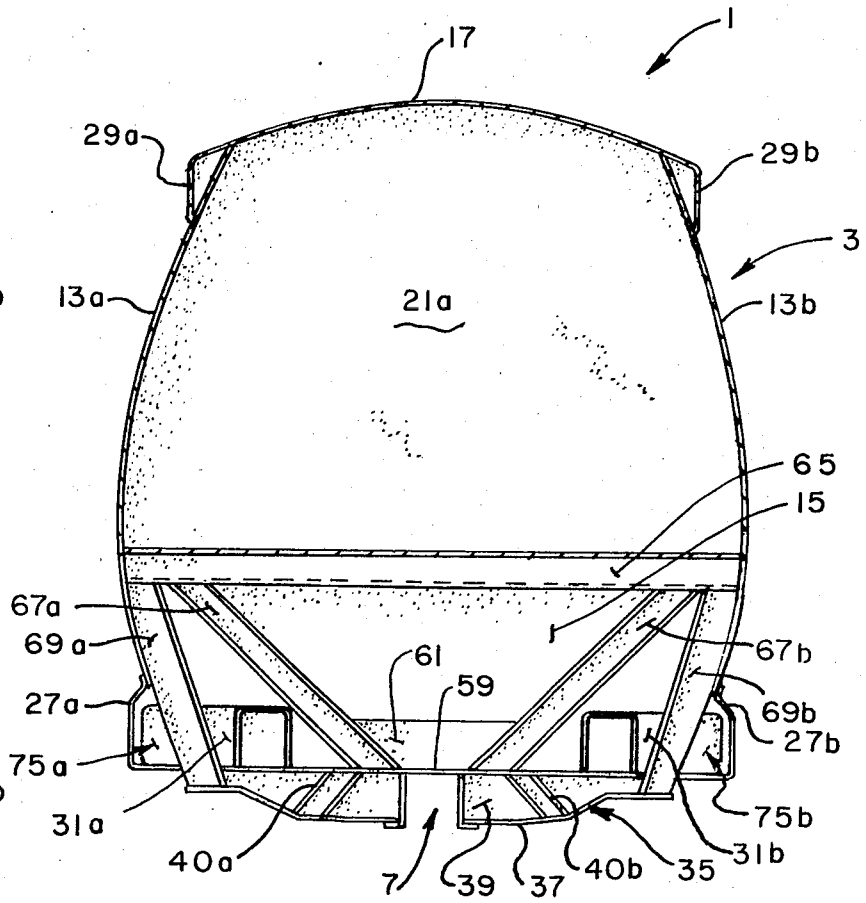
FIG. 5 is a cross sectional view of the car, taken along line 5—5 of FIG. 2.
Figure 4:
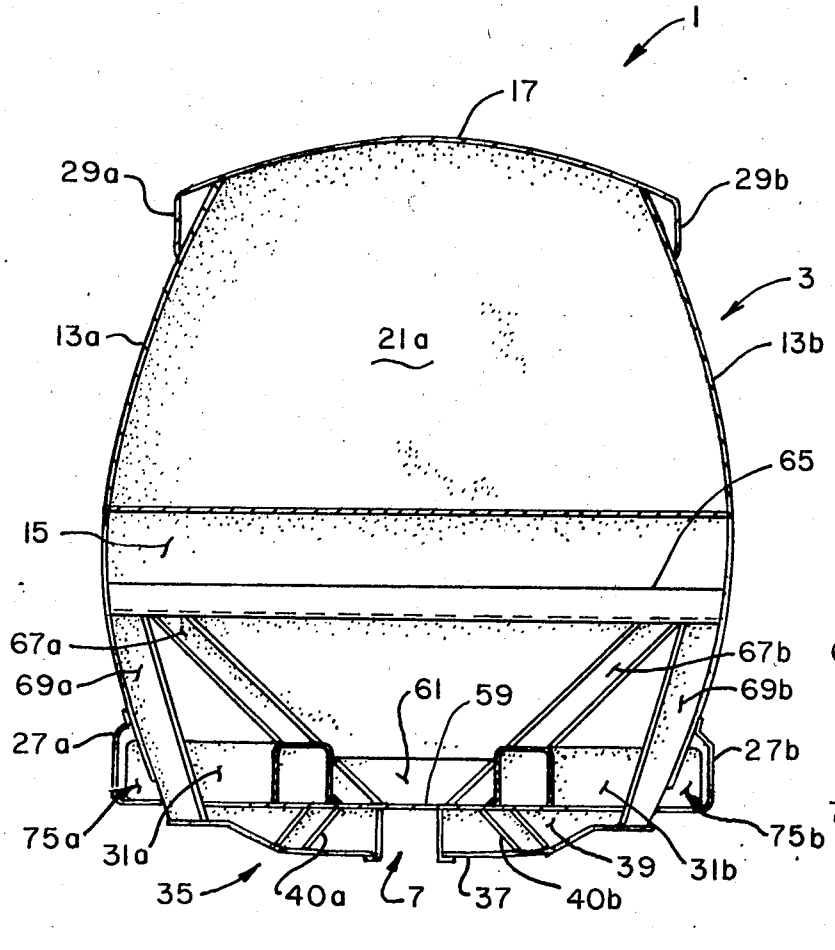
FIG. 4 is a vertical cross sectional view of the car, taken along line 4—4 of FIG. 2.

More specifically, end structure 5 of the present invention includes a center stub sill assembly, as generally indicated at 7, to which a coupler 9 (see FIG. 2) is attached. The coupler 9 transfers longitudinal train loads, including tension or draft loads, compression or squeeze loads, and impact loads to the center stub sill assembly. Coupler 9 also transfers certain vertical and lateral loads to the center stub sill assembly. Railroad car 1 rides on a pair of truck assemblies 11, one at each end of the car. The truck assemblies, as shown in phantom in FIG. 2, are conventional and only parts of the truck assembly, as they apply to the end structure 5 of the present invention, will be described in detail.

Car body 3 includes side sheets 13a, 13b forming the sides of the hopper car, with an end floor or slope sheet 15 at either end of the side sheets. A roof 17 is attached to the upper ends of the side sheets and to the upper ends of the end slope sheets so that the car body is totally enclosed. Partition and slope sheets 19 (see FIG. 2) divide the interior of the car body into a plurality of hoppers, as indicated at 21*a*–21*d*, extending lengthwise of the car. Each of these hoppers has intermediate floor sheets 23, which leads downwardly to a hopper outlet, as generally indicated at 25. The specific structure of hopper outlet will not be described in detail inasmuch as the hopper outler does not, per se, relate to the present invention. Hoppers 21*a*–21*d* may be loaded via hatch covers 26*a*–26*d* in the conventional manner.

Figure 9:
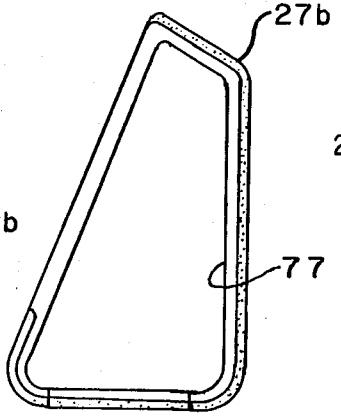
FIG. 9 is a cross sectional view of the side sill and of the casting, taken along line 9—9 of FIG. 7.
Figure 6:
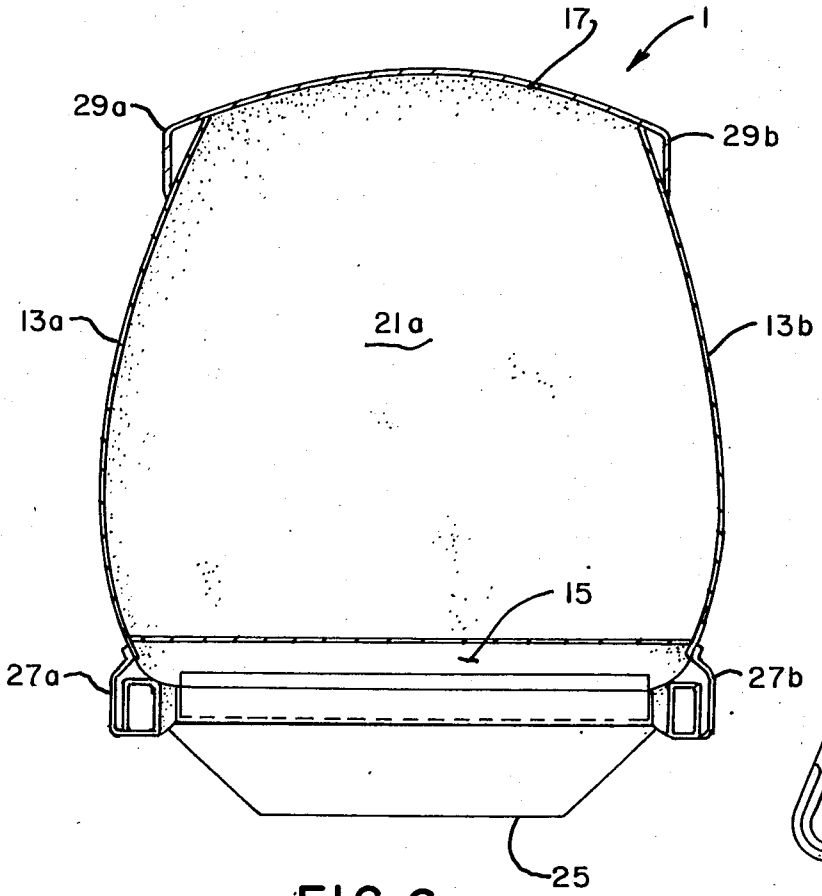
FIG. 6 is an vertical cross sectional view of the car, taken along line 6—6 of FIG. 2.
Figure 10:
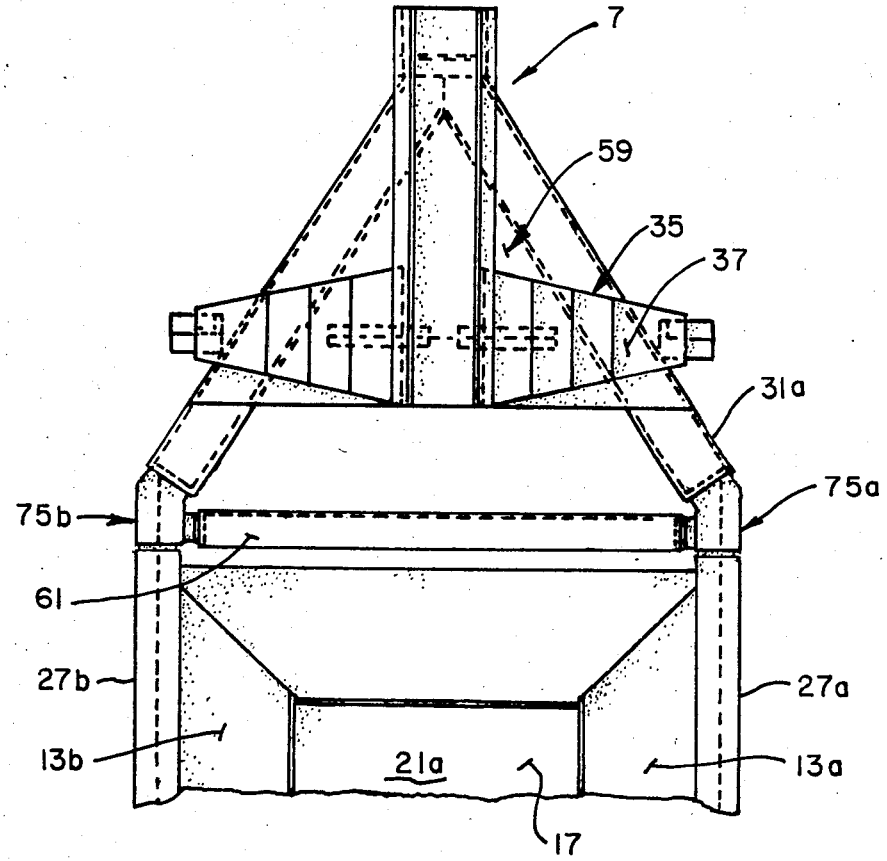
FIG. 10 is a bottom plan view of the end structure of the present invention.

Further, car body 3 includes a pair of side sills 27*a*, 27*b* securely attached (welded) to the lower marginal portions of respective side sheets 13*a*, 13*b*, with the side sills 27*a*, 27*b* extending substantially the entire length of the side sheets. Side sills 27*a*, 27*b* transfer longitudinal loads the length of the car generally proximate the lower portions of the side sheets 13*a*, 13*b*. As generally shown in FIG. 9, each side sill 27*a*, 27*b* is a box beam of generally trapezoidal cross section. The upper portions of side sheets 13*a*, 13*b* are reinforced by side plates 29*a*, 29*b*, respectively, attached to the upper portions of each of the side sheets for reinforcing the side sheets against buckling under compressive and other loading conditions.

In accordance with the present invention, end structure of the present invention joins the ends of the side sills 27*a*, 27*b* to the center stub sill assembly 7 at each end of the car so as to effectively transmit train loads from the coupler 9 and center stub sill assembly 7 to the side sills, these train loads including tension (or draft) loads, compression (or squeeze) loads, and impact loads. Additionally, end structure 5 of the present invention includes truss means 33 (as will be hereinafter described in detail) for effectively withstanding and reacting bending or overturning moments induced by the lading within car body 3 as applied to the ends of the car body.

More specifically, in accordance with this invention side sills 27*a*, 27*b* each have respective diagonal side sill extensions or end portions 31*a*, 31*b* which are rigidly secured (e.g., welded) to the ends of their respective side sills in a manner as will appear. The sill extensions 31*a*, 31*b* are box beams which extend diagonally from the ends of the side sills toward the longitudinal centerline of the car. As best shown in FIG. 2, the sill extensions 31*a*, 31*b* and the side sills 27*a*, 27*b* are spaced somewhat above the axis of the center stub sill assembly 7 and coupler 9.

A body bolster, as generally indicated at 35, is rigidly secured to the bottom of sill extensions 31*a*, 31*b*, to center stub sill 7, and to truss means 33 so as to support one end of the car body 3 on truck 11. Body bolster 35 includes a lower cover plate 37 and a vertically disposed body bolster web 39 extending upwardly from lower cover plate 37. Web gusset members 40*a*, 40*b* stiffen bolster web 39. As shown best in FIG. 1, center stub sill assembly 7 includes a pair of spaced angle members, as generally indicated at 41*a*, 41*b*, which are secured (e.g., welded) to body bolster 35. Angle members 41*a*, 41*b* are spaced apart from one another and each has a respective vertical flange 43*a*, 43*b* (as best shown in FIG. 1) spaced apart from one another a distance so as to receive a coupler 9 in the conventional manner. Additionally, angle members 41*a*, 41*b* each include respective outwardly extending legs 45*a*, 45*b*.

Figure 3:
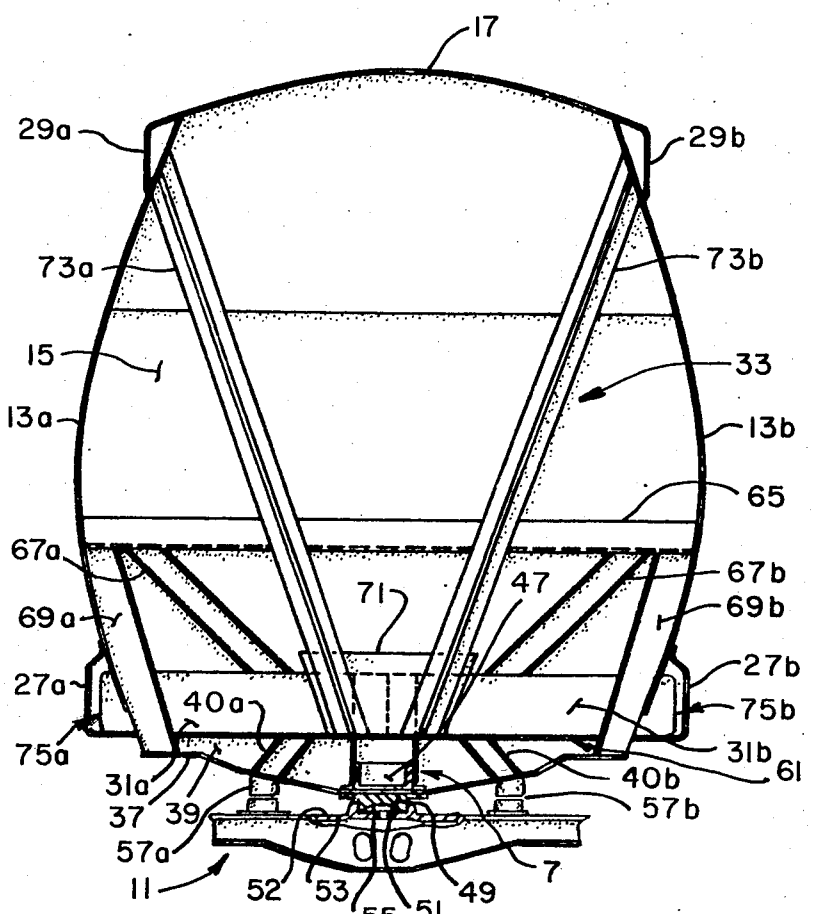
FIG. 3 is an end elevational view of the railroad car shown in FIG. 2.

Installed between and welded to vertical spaced flanges 43*a*, 43*b* of angle members 41*a*, 41*b* constituting the center stub sill assembly 7, a so-called center plate 47 is secured (see FIG. 3). The center plate has a downwardly extending center plate body 49, having a downwardly facing surface 51. Truck assembly 11 has an upper cover plate 52 extending transversely of the truck, and a truck center plate bowl 53 is provided in the center of cover plate 52, with a bearing insert 55 received in the bowl and with the bearing insert having an upwardly facing surface so as to bear against and to mate with the downwardly facing surface 51 of the center plate body 49 thereby to support the weight of the one end of the car on truck assembly 11. As shown in the co-assigned U.S. Pat. No. 3,709,151, so-called side truck bearings 57*a*, 57*b* are provided on either side of the truck center plate bowl 53 so as to support body bolster 35 on opposite sides of truck center plate bowl 53. This constuction is substantially conventional, and does not, per se, constitute a part of the present invention. The above-noted co-assigned U.S. Pat. No. 3,709,151 is herein incorporated by reference, and details of the construction of body bolster 35 and of truck assembly 11 may be seen in greater detail by referring to the above-noted U.S. patent. Within the broader aspects of this invention, truck assemblies having a different construction than that discussed above may be employed.

Turning now to a more detailed discussion of end structure 5 of the present invention, the end structure includes a generally triangular shaped tie or gusset plate, as generally indicated at 59, rigidly secured (e.g., welded) to the lower faces of the box beams constituting side sill extensions 31*a*, 31*b*, so that the tie plate forms the lower horizontal web of the side extension box beams. The tie plate also extends axially inwardly toward the mid-portion of the car generally from the intersection of the side sill extensions at the centerline of the car to a point outwardly of the ends of the side sills 27*a*, 27*b*. This tie plate 59 is of relatively heavy construction (e.g., about one-half inch in thickness), and the outer edges of the tie plate are generally co-terminal with the outer edges of the side sill extensions. In addition, the vertial spaced flanges 43*a*, 43*b* of the center stub sill assembly 7 are welded to the bottom face of the tie plate so that the tie plate also forms the upper horizontal web of the stub center sill assembly and the upper web of the body bolster 35. Further, the upper edges of the body bolster web 39 are welded to the underface of tie plate 59 so as to rigidly secure both center stub sill assembly 7 and body bolster 35 to end structure 5 of the present invention. Thus, in addition to serving as a gusset between the stub sill, the side sill extension, and the body bolster, tie plate 49 also serves as the horizontal webs of the center stub sill 7, the side sill extensions 31*a*, 31*b*, and the body bolster 35.

End structure 5 also includes a so-called sill strut or tie beam 61 which extends transversely of end slope sheet 15 between the ends of side sills 27*a*, 27*b*. The sill strut beam 61 is rigidly secured (welded) to the outer face of end slope sheet. The sill strut 61 serves to reinforce the lower portion of end slope sheet 15, and is rigidly secured (in a manner as will hereinafter appear) to the ends of side sills 27*a*, 27*b* for positively locating the ends of the side sills relative to one another, and for effectively transmitting compression and tension loads between the ends of the side sills substantially without transferring compression or tension loads between the side sills to the relatively thin end slope sheet 15.

As indicated at 63*a*, 63*b* in FIG. 2, each of the side sheets 13*a*, 13*b* extend somewhat beyond the ends of their respective side sills 27*a*, 27*b*. A so-called transverse end slope sheet support member 65 is welded to end slope sheet 15 above the level of body bolster 35, and to side sheet extensions 63*a*, 63*b* proximate the intersection of the end slope sheet 15 and the side sheets 13*a*, 13*b*. Support beams 67*a*, 67*b* extend downwardly and inwardly from the respective outer ends of transverse end slope sheet support 65 and are secured or welded to the upper face of tie plate 59. Additionally, at the outermost ends of transverse end slope sheet support 65, so-called outer support beams 69*a*, 69*b*, having curved outer faces adapted to mate with the radius of curvature of their respective curved side sheet extensions 63*a*, 63*b*, extend downwardly and are secured to the outermost ends of body bolster 35. As is best shown in FIG. 2, transverse end slope sheet support 65, support beams 67*a*, 67*b*, and outer support beams 69*a*, 69*b*, together with body bolster web 39 are disposed generally in the same transverse vertical plane.

A vertical front end sill plate 71 is affixed to the ends of sill extensions 31*a*, 31*b* and to the end of tie plate 59. As is best shown in FIG. 1, end sill plate 71 is spaced back from the end of center stub sill assembly 7. The ends of side sill extensions 31*a*, 31*b* are shaped so as to abut the transverse end sill plate 71. A pair of vertically disposed tension compression tie members, as indicated a 73*a*, 73*b*, are secured to the upper end of car body 3 and extend inwardly and downwardly form the outer ends of side plates 29*a*, 29*b* to the top of the center stub sill assembly 7, with the lower ends of the tension compression tie members being welded to the outer face of end sill plate 71, and with the upper ends of the tension tie members being welded to the upper ends of car body 3. It will be appreciated that tie members 73*a*, 73*b* serve to transmit tension loads from the upper portion of car body 3 to the center sill assembly when overturning moments are applied to car body 3, such as under impact conditions and under squeeze loading. Under draft and coupler uplift loading conditions, members 73*a*, 73*b* are in compression.

As heretofore stated, side sill expressions 31*a*, 31*b* are rigidly secured to the ends of their respective side sills 27*a*, 27*b*. This may, of course, be accomplished by beveling the ends of the side sill extensions 31*a*, 31*b* so that they may be welded around their periphery to their respective side sills. However, a preferred method of joining the diagonal side sill extensions 31*a*, 31*b* to their respective side sills 27*a*, 27*b* and of joining sill strut beam 61 to the ends of the side sills utilizes a connector member, as generally indicated at 75*a*, 75*b*, of suitable material (e.g., cast steel) so as to permit the connector member to be readily fitted into the open ends of the side sills, of the sill extensions, and of the sill strut 61 so as to permit these members to be properly positioned relative to one another and to be held at their desired angles relative to one another, and so as to provide a surface to which the various members may be welded and held in predetermined relation while they are being welded. It will also be understood that through the use of cast, rigid, integral connector members 75*a*, 75*b*, the welds securing the various members to the connector member are separated from one another, and the integral connector member permits uniform load transfer between the various members and their respective welds joining them to the connector member. Also, by use of rigid connector members 75*a*, 75*b*, less tooling and fixtures are required during fabrication of car end structure 5 of the present invention, thus reducing the labor (and hence the cost) of fabrication of the end structure.

Figure 7:
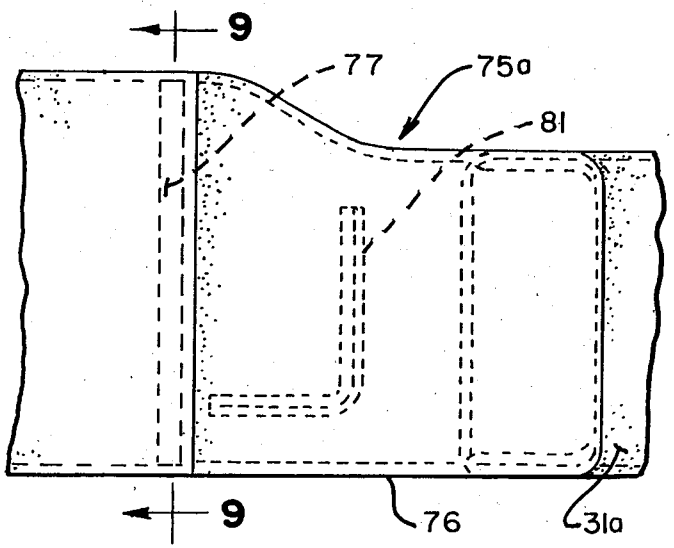
FIG. 7 is an enlarged detail, taken along line 7—7 of FIG. 2, illustrating in enlarged scale the side elevation of the end portion of the end side sill, and further illustrating a unitary casting for joining the side sills and the sill diagonals or extensions, and further for joining a transverse beam or strut extending between the ends of the side sills.
Figure 8:
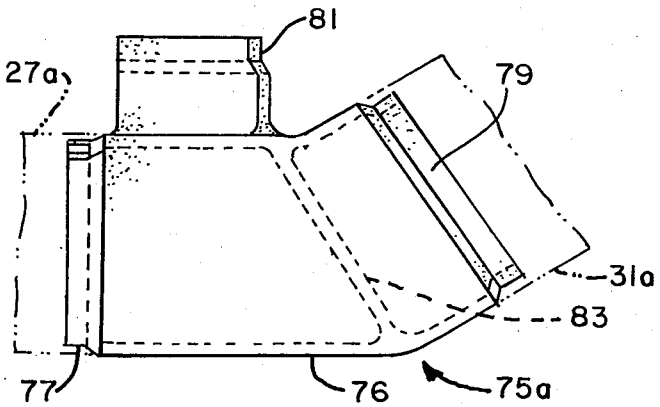
FIG. 8 is a top plan view of the casting shown in FIG. 7 on a somewhat smaller scale.

More specifically, referring to FIGS. 7 and 8, each connector member 75*a*, 75*b* comprises an intergral connector body casting 76 of cast steel or the like, having a side sill connector portion 77 adapted to be shaped similar to the inside cross section of a respective side sill 27*a*, 27*b* (at best shown in FIG. 9) so as to have a snug sliding fit within at least a portion of the hollow side sill. It will be understood that the portion of connector body 76 which is necked down so as to constitute side sill connector portion 77 and the end face of the side sill form a generally perpendicular intersection which permits the ready welding of the side sill to the connector body assuring good weld penetration in both the side sill and of the connector body. It will also be appreciated that the thickness of the connector body in the area of the weld zones is preferably about the same thickness as the side sills so as to result in uniform weld strength. Likewise, a sill extension connector portion 79 is provided at the opposite end of connector body 76 so as to fit within the open end of the box beam constituting a respective sill extensions 31*a*, 31*b*. As heretofore explained in regard to side sill connector 77, a good interface between the side sill extensions and the connector body 76 is provided for ensuring optimum welding. Forward of side sill connector 77 and disposed on the inside face of the connector body 76, a sill strut beam connector 81 is provided so as to permit the side strut 61 to be readily welded to connector body 76. A stiffening web 83 is provided internally of body 76 so as to more effectively transmit compression and tension loads, shear loads and moments between the various members secured to the connector body casting. While connector members 75*a*, 75*b* were heretofore described as preferably fitting into the open ends of the side sills and other members, within the broader aspects of this invention, connector members may fit over the outsides of the side sills and other members for alignment and welding purposes. While connector members 75*a*, 75*b* were described as preferably being integral castings, it will be understood that within the broader aspects of this invention that connector members 75*a*, 75*b* may be weldments constructed of a number of steel plates and other parts welded together so as to constitute a unitary connector.

Figure 11:
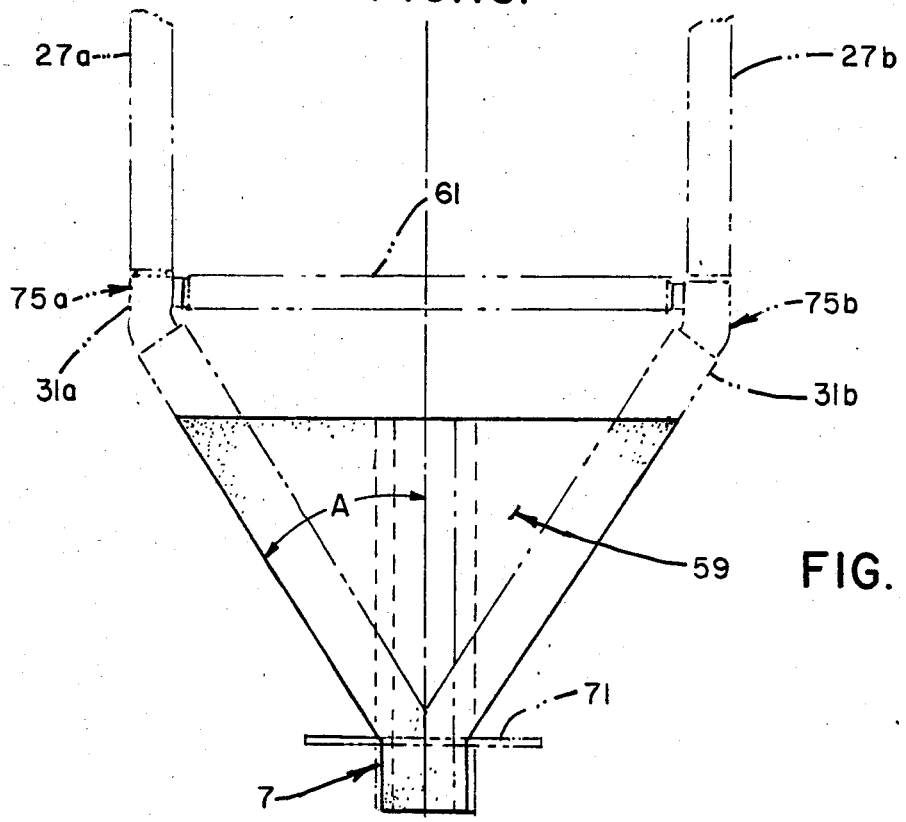
FIG. 11 is a top plan view of a portion of the end structure of the car, showing the center stub sill and a so-called tie plate in solid lines, and showing the end sill diagonals, the side sills, the center stub sill, and the sill strut in phantom, the latter members being above the level of the tie plate, as shown in FIG. 2.

Referring to FIG. 11, it will be noted that tie plate 59 (shown in solid lines) is generally of a V-shape, with the outer margins of the tie plate being generally co-terminal with the outer edges of sill extensions or diagonals 31*a*, 31*b* (shown in phantom). Further, the end of tie plate 59 toward car body 3 is generally co-terminal with the end of center stub sill assembly 7. It will be further noted that the angle between the longitudinal centerline of the car and the centerline of the sill diagonals 31*a*, 31*b* is indicated by A. Within the broader aspects of the present invention, angle A may vary between about 20 and 70 degrees. In the embodiment shown in FIG. 11, angle A is about 30 degrees.

Referring to FIG. 12, a typical center stub sill car is shown having a center stub sill 7' and a pair of spaced side sills 27*a*', 27*b*' which extend the full length of car body 3' and which extend longitudinally out beyond the ends of the car body. A relatively deep shear plate SP is welded to the inner faces of the side sills and to the center stub sill so as to carry longitudinal loads in transverse direction between the side sills and the center stub sill.

Those skilled in the art will appreciate that the replacement of a shear plate arrangement, such as is shown in FIG. 12, with the diagonal side sill extensions 31*a*, 31*b* of the present invention may be utilized in conjunction with any center stub sill railway car having a center stub sill and a pair of spaced side sills.

In operation and service, it will be appreciated that the car end structure 5 of the present invention results in a car end structure in which the various structural members constituting the end structure primarily carry statically determinate loads such that efficient use of materials in the car end structure can be utilized, thereby permitting the use of the minimum amount of material, and yet ensuring that the car end structure will adequately withstand all anticipated loads with an adquate margin of safety. By utilizing the car and structure 5 of the present invention, it is anticipated that approximately 2,300 pounds (1,044 kg.) will be saved on a typical covered hopper car utilizing the car end construction 5 of the present invention, as compared to a similar conventional center stub sill car using a shear plate, as shown in FIG. 12. This weight savings represents a significant amount of weight savings allowing additional lading to be carried by the car, and also reducing fuel consumption of a train including cars of the present invention. It is also anticipated that in the event repair of end structure 5 of the present invention becomes necessary, repair of specified structural members will be easier and will require less time than with prior art car end structures.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A center stub sill railway car having a center stub sill at each end of the car and a pair of spaced side sills extending generally longitudinally of the railway car, a car body supported on said side sills, said side sills carrying longitudinal loads along the length of said car body, said car body having an end disposed at least in part above a respective said center stub sill, means at each end of the car extending diagonally between the end portions of said side sills and a respective center stub sill for transmitting all of said longitudinal loads between said center stub sill and said side sills, a beam extending transversely of the car at each end thereof and being secured to the ends of said side sills so as to withstand transverse tension and compression loads between said side sills upon longitudinal compression and tension loads being transmitted between said center stub sill and said side sills via said diagonal means, and means disposed in a generally vertical plane interposed between said car body end and said center stub sill for withstanding moments at the ends of said car body, said diagonal means comprising an extension of each of said side sills extending diagonally inwardly of the railway car toward said center stub sill at an angle ranging between about 20 and 70 degrees, said sill extensions each being rigidly secured to the end of its respective side sill and to said center stub sill, said car further comprising a horizontal tie plate rigidly secured to said center stub sill and to said sill extensions, but clear of said side sills and of said beam.

2. A center stub sill railway car as set forth in claim 1 further comprising a body bolster secured to said center stub sill and extending transversely of the car, and a reinforcing member extending transversely of the car secured to the outer surface of the end of said car in generally vertical alignment with said body bolster, and reinforcement members extending in a generally vertical plane between said reinforcing member and said body bolster.

3. A center stub sill railway car having a center stub sill at each end of the car and a pair of spaced side sills extending generally longitudinally of the railway car, a car body supported on said side sills, said side sills carrying longitudinal loads along the length of said car body, said car body having an end disposed at least in part above a respective said center stub sill, means at each end of the car extending diagonally between the end portions of said side sills and a respective center stub sill for transmitting all of said longitudinal loads between said center stub sill and said side sills, a beam extending transversely of the car at each end thereof and being secured to the ends of said side sills so as to withstand transverse tension and compression loads between said side sills upon longitudinal compression and tension loads being transmitted between said center stub sill and said side sills via said diagonal means, and means disposed in a generally vertical plane interposed between said car body end and said center stub sill for withstanding moments at the ends of said car body, said car further comprising a unitary connector member at each end of each of said side sills for connecting said side sills, said diagonal means, and said beam.

4. A center stub sill railway car as set forth in claim 3 wherein said connector is a casting having a portion interfitting with the end of a respective side, another portion interfitting with said diagonal means, and a third portion interfitting with said beam so as to facilitate welding of said side sill, said diagonal means, and said beam to said connector casting.

5. In a railroad car having a side sheet on each side of the car, a side sill secured to each side of said car body, said sill sills carrying longitudinal loads along said car body, wherein the improvement comprises: end structure means at each end of the car, said end structure means including a center stub sill disposed substantially along the longitudinal centerline of the car, a body bolster extending transversely of the car, a truck assembly disposed below said body bolster, said truck interfitting with said body bolster for supporting one end of said car, side sills having sill extensions secured thereto angling diagonally inwardly toward said center stub sill for transferring loads therebetween, and a tie plate generally V-shaped in plan view, said tie plate being sized so as to be securely joined to said center stub sill, to said body bolster, and to said side sill extensions, but said tie plate being free of said side sills, thereby to constitute a horizontal web for said center stub sill, said body bolster and said side sill extensions.

6. An end structure for a center stub sill railway car, the latter having a car body having a plurality of hoppers including an end hopper at each end thereof, said car body having a pair of side sheets, a pair of side sills extending lengthwise of said car body and carrying longitudinal loads along said car body, said end structure comprising a center stub sill extending longitudinally from an end of the car toward a respective end hopper of the car, said side sills having sill extensions secured thereto angling diagonally inwardly toward said center stub sill for transferring all of the longitudinal loads therebetween, a body bolster assembly secured to said center stub sill, said body bolster extending transversely of the car, a tie plate secured to said bolster assembly and to said center stub sill so as to constitute an upper cover plate for said bolster assembly and an upper horizontal web for said center stub sill, said tie plate being free of said side sills and said car body thereby to prevent the transfer of longitudinal loads between said center stub sill and said side sills via said tie plate, said car body having an end sheet extending at least in part over said body bolster assembly and over said center stub sill, a generally horizontal reinforcing member secured to said end sheet and extending transversely of the car, a pair of reinforcing members extending in a generally vertical plane between the ends of said body bolster assembly and said horizontal reinforcing member, and a pair of diagonal reinforcement members extending in a generally vertical plane between said tie plate adjacent said center stub sill and said horizontal reinforcing member.

7. An end structure as set forth in claim 6 wherein each said side sill has an end portion beginning generally at the lower portion of said end sheet and angling inwardly with respect to the longitudinal centerline of the car toward said center stub sill, said end portions being secured at one end to their respective side sills and being secured at their other or outer ends to said center stub sill.

8. An end structure for a center stub sill railway car, the latter having a pair of side sheets, a pair of side sills, said end structure comprising a center stub sill extending longitudinally from an end of the car toward a respective end hopper of the car, a body bolster assembly secured to said center stub sill, said body bolster extending transversely of the car, an end sheet extending at least in part over said body bolster assembly and over said center stub sill, a generally horizontal reinforcing member secured to the end sheet and extending transversely of the car, a pair of reinforcing members extending in a generally vertical plane between the ends of said bolster assembly and said horizontal reinforcing members, and a pair of diagonal reinforcement members extending between said bolster assembly and said horizontal reinforcing member, each said side sill having an end portion beginning generally at the lower portion of said end sheet and angling inwardly with respect to the longitudinal centerline of the car toward said center stub sill, said end portions being secured at one end to their respective side sills and being secured to their other or outer ends to said center stub sill, wherein said angled side sill end portions extend over said bolster assembly inwardly of said reinforcing members extending between said bolster assembly and said horizontal reinforcing member.

9. In a center stub sill railway car having a car body, a side sill secured to each side of said car body, the improvement comprising: an end structure assembly at each end of the car, each said end structure including a center stub sill, a tie plate secured to said center stub sill, but free of said side sills, each of said side sills extending longitudinally of the car body along the lower portions of said car body, a pair of side sill extensions, one for each of said side sills, extending inwardly form the end of a respective side sill toward said center stub sill for carrying all of the longitudinal loads between said side sills and said center stub sill, said side sill extensions being secured to said tie plate, and means for connecting each of said sill extensions to its respective side sill.

10. A railway car as set forth in claim 9 wherein said connecting means comprises a unitary connector having portions adapted to interfit with a respective end of said side sill and with an end of said sill extension thereby to permit said connector to be welded relative to its respective said side sill and sill extension.

11. In a railway hopper car as set forth in claim 10 further comprising a strut member extending transversely of said car proximate the ends of said side sills at each end of the car, the ends of said strut member being secured to said connector, and said strut member being secured to a respective end of said car body.

12. A covered railway hopper car having a side sheet at each side of the car, a side sill secured along the lower marginal portion of each of said side sheets, a roof secured between the upper margins of said side sheets, a plurality of hoppers spaced at intervals along the length of the car including an end hopper at each end of the car, each end hopper having an inclined end hopper slope sheet, each of said end hopper slope sheets having, intermediate its length, a generally horizontal reinforcing member secured thereto extending between said side sheets, and end structure means at each end of the car including a center stub sill, a body bolster extending transversely of the car and having a lower bolster cover plate extending transversely of the car, a single plate over said center stub sill and said body bolster forming both an upper horizontal web of said center stub sill and an upper cover plate for said body bolster, said plate being free of said side sills, a pair of reinforcing members extending in a generally vertical plane between the ends of said bolster lower cover plate and said generally horizontal reinforcing member secured to said end slope sheet, each of said side sills having a main center portion extending longitudinally of the car and an end portion at each end thereof extending inwardly at an angle with respect to the longitudinal centerline of the car, said end portion of said side sill being secured at its outer end to said center stub sill for transferring substantially all longitudinal loads between said center stub sill and said main center portion of said side sill.

13. A covered hopper railway car comprising a pair of side sheets extending substantially the length of the car, a roof supported at least in part by the uper marginal portions of said side sheets, and end slope sheet extending between said side sheets at each end of the car, intermediate transverse sheets extending between said side sheets defining a plurality of hoppers extending lengthwise of the car with an end hopper at each end of the car, a side sill secured to the lower marginal portion of each of said side sheets, each of said side sills extending lengthwise of the car, a center stub sill assembly located generally on the longitudinal centerline of the car out beyond the ends of said side sills, and end structure means interconnecting said center stub sill to said side sills and to the end of said car, said end structure means comprising a pair of sill extensions, one for each of said side sills, extending inwardly from the end of said side sills toward the longitudinal centerline of said car for carrying substantially all of the longitudinal loads between said side sills and said center stub sill, said sill extensions being secured to the ends of said side sills and to said center stub sill, a tie plate interposed between said center stub sill assembly and said sill extensions but free of said side sills, a body bolster extending transversely of said car intermediate the outer end of said center stub sill assembly and the ends of said side sills, a horizontally extending reinforcing member secured to said end slope sheet located substantially vertically above said body bolster, outer reinforcing members extending in a generally vertical plane between said horizontal reinforcing member and the outer ends of said body bolster assembly, inner reinforcing members extending between said horizontal reinforcing member and said body bolster, and a strut secured to the intersection between said side sills and said sill extensions and secured to said end sheet below said horizontal reinforcing members, and a pair of diagonal member extending between the upper portion of said end hopper and said center stub sill.

* * * * *